US005557166A

United States Patent [19]

Watase et al.

[11] Patent Number: 5,557,166

[45] Date of Patent: *Sep. 17, 1996

[54] REFLECTION-TYPE PHOTOELECTRONIC SURFACE AND PHOTOMULTIPLIER

[75] Inventors: Yasushi Watase; Hiroaki Washiyama; Toshio Ikuma, all of Hamamatsu, Japan

[73] Assignee: Hamamatsu Photonics K.K., Hamamatsu, Japan

[ * ] Notice: The term of this patent shall not extend beyond the expiration date of Pat. No. 5,336,966.

[21] Appl. No.: 457,744

[22] Filed: Jun. 1, 1995

Related U.S. Application Data

[63] Continuation of Ser. No. 46,958, Apr. 16, 1993, abandoned.

[30] Foreign Application Priority Data

Apr. 22, 1992 [JP] Japan ..... 4-102945

[51] Int. Cl.[6] ..... H01J 40/16

[52] U.S. Cl. ..... 313/524; 313/373; 313/375; 313/377; 427/74

[58] Field of Search ..... 313/524, 373, 313/375, 377; 427/74

[56] References Cited

U.S. PATENT DOCUMENTS

| | | | |
|---|---|---|---|
| 2,264,717 | 12/1941 | Ruedy | 445/11 |
| 3,498,834 | 3/1970 | Rome et al. | 427/75 |
| 3,676,586 | 7/1972 | Uno | 358/472 |
| 3,771,004 | 11/1973 | Plumeau | 313/536 |
| 3,867,662 | 2/1975 | Endriz | 313/542 |
| 4,002,735 | 1/1977 | McDonie et al. | 427/78 |
| 4,039,887 | 8/1977 | McDonie | 313/346 R |
| 4,311,939 | 1/1982 | Faulkner et al. | 313/533 |
| 4,339,469 | 7/1982 | McDonie et al. | 427/10 |
| 4,341,427 | 7/1982 | Tomasetti et al. | 445/6 |
| 4,419,603 | 12/1983 | Nussli et al. | 313/346 R |
| 5,012,107 | 4/1991 | Kano et al. | 250/484.4 |
| 5,336,966 | 8/1994 | Nakatsugawa et al. | 313/532 |

FOREIGN PATENT DOCUMENTS

| | | | |
|---|---|---|---|
| 5074406 | 3/1993 | Japan . | |
| 0532358 | 3/1993 | Japan | H01J 1/34 |

OTHER PUBLICATIONS

"S–11 and S–20 Photocathode Research Activity", SPIE vol. 491 High Speed Photography (Strasbourg 1984), pp. 287–293.

*Primary Examiner*—Alvin E. Oberley
*Assistant Examiner*—Lawrence O. Richardson
*Attorney, Agent, or Firm*—Cushman Darby & Cushman, L.L.P.

[57] ABSTRACT

The photocathode according to this invention is characterized in that an aluminium thin film is formed on a substrate, and then an antimony thin layer is deposited directly on the aluminium thin film and is activated by an alkali metal. It is especially preferable that the antimony thin layer is deposited in a thickness of 15 μg/cm$^2$ to 45 μg/cm$^2$ and is activated by an alkali metal. Such reflection-type photocathode is applicable to photomultipliers. Among functions which are considered to be done by the Al film. which is in direct contact with the Sb layer, a first one is to prevent the alloying between the Sb layer and the substrate (e.g., Ni), and a second one is to augment a reflectance of light to be detected.

10 Claims, 3 Drawing Sheets

REFLECTION-TYPE PHOTOELECTRONIC SURFACE AND PHOTOMULTIPLIER

This is a continuation of application Ser. No. 08/046,958, filed on Apr. 16, 1993, which was abandoned upon the filing hereof.

BACKGROUND OF THE INVENTION

1. Field of the Invention

This invention relates to a reflection-type photocathode (i.e. photoelectric surface), and a photomultiplier.

2. Related Background Art

Reflection-type photocathodes using nickel (Ni), etc. as the substrates are known in the art disclosed in a first literature, U.S. Pat. No. 4,160,185, a second literature, Japanese Patent Laid-Open Publication No. 87274/1974 and a third literature, Japanese Patent Publication No. 47665/1977.

The first literature discloses the art in which an aluminium oxide ($Al_3O_3$) layer is formed on a Ni substrate, and antimony (Sb) is deposited on the $Al_2O_3$ layer and is activated by alkali metals.

The $Al_2O_3$ layer is provided for the prevention of the alloying of the Ni and Sb.

The second literature discloses the art in which a surface of an Al substrate (or a substrate having Al applied to a surface of a base) is oxidized to form an $Al_2O_3$ layer, and a reflection-type photocathode containing Sb and alkali metals is formed. The base for Al to be applied to is exemplified by tantalum (Ta).

In the third literature as well, a surface of an Al substrate is oxidized to form an $Al_2O_3$ layer, and a photocathode containing Sb activated by alkali metals is formed.

As described above, each of the conventional reflection-type photocathodes has the $Al_2O_3$ layer below the activated Sb film which is a photosensitive layer. Therefore, their fabrication process essentially includes the step of oxidizing Al.

Photomultipliers are used for the photometry of feeble light, and are effective especially at a limit where light to be detected is measured by counting photons. Accordingly, the sensitivity improvement by even some percentage is significant, and the process control is very difficult.

A restrictive condition that the $Al_2O_3$ layer is necessary not only lowers yields of their fabrication, but also makes it difficult to realize a stable sensitivity. Depending on characteristics of the $Al_2O_3$ layer, the reflection-type photocathodes adversely have various sensitivities.

SUMMARY OF THE INVENTION

In view of these disadvantages, the inventors have made studies and found that a good reflection-type photocathode can be realized without the step of forming an $Al_2O_3$ layer. In addition, they have found optimum conditions for the fabrication of the reflection-type photocathode without the step of forming the $Al_2O_3$ layer.

The reflection-type photocathode according to this invention is characterized in that an aluminium thin film is formed on a base substrate, and an antimony thin layer is deposited directly on the aluminium thin film and is activated by an alkali metal. It is especially preferable that the antimony thin layer is deposited in a thickness of 15 $\mu g/cm^2$ to 45 $\mu g/cm^2$ and is activated by alkali metals. Such photocathode is applicable to photomultipliers. In the above description, the unit of the layer thickness is noted $\mu g/cm^2$ which is equivalent to the dimention of length. This notation is used in the followings.

The reflection-type photocathode according to this invention comprises the alkali metals-activated Sb thin layer directly formed on the Al thin film without the special step of forming an $Al_2O_3$ layer. This is an innovation to the conventional reflection-type photocathodes. That is, even when the Sb layer is deposited directly on the Al film as long as the Sb layer is thin, satisfactory results can be obtained. When the Sb layer has a thickness of 15 $\mu g/cm^2$ to 45 $\mu g/cm^2$, this invention is especially significant.

It is considered that the Al film, which is in direct contact with the Sb layer, has among various functions a first function of preventing the alloying of the Sb layer with the base substrate (e.g., Ni), and a second function of increasing a reflectivity of light to be detected. This invention has successfully achieved a reflection-type photocathode of high sensitivity and high yields.

DESCRIPTION OF THE PREFERRED EMBODIMENT

Figure 1:
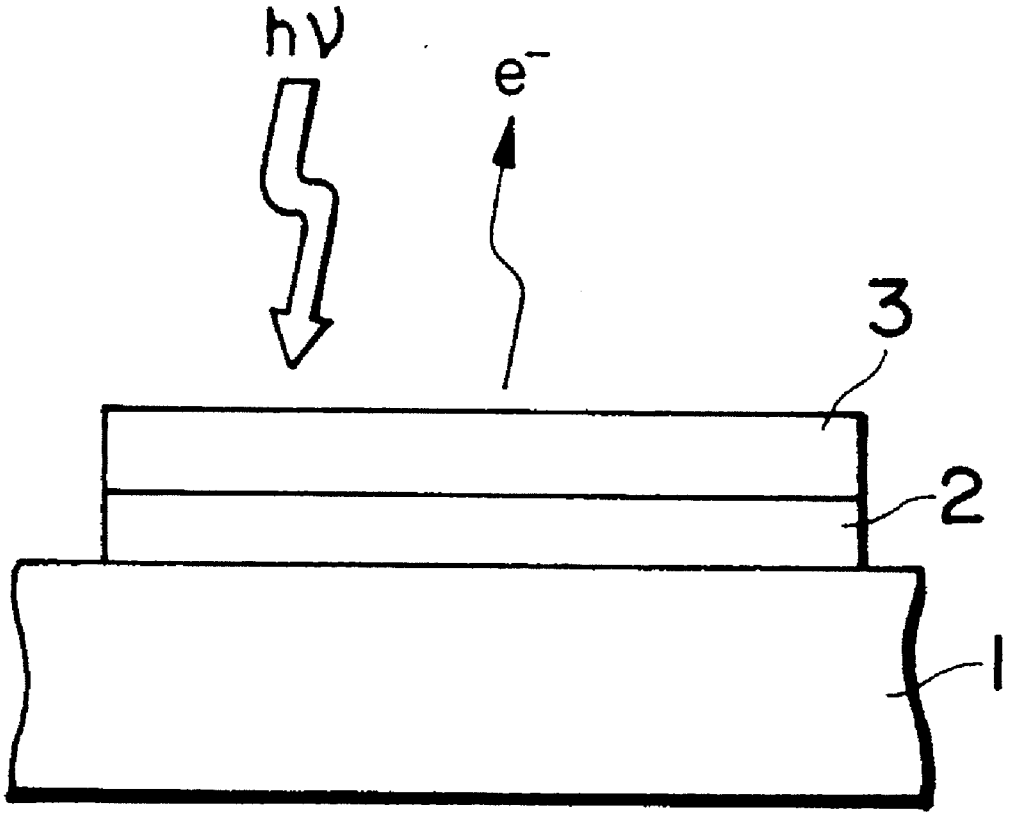
FIG. 1 is a sectional view of the reflection-type photocathode according to an embodiment of this invention.

An embodiment of this invention will be explained in good detail. As shown in FIG. 1, an Al thin film 2 is formed on, e.g., a base substrate of,e.g., Ni by, e.g., vacuum vaporization. A photosensitive layer 3 containing Sb activated by alkali metals, such as cesium (Cs), potassium (K), sodium (Na), etc., is formed on the Al film 2. When light hv is incident on the reflection-type photocathode of FIG. 1, in accordance with an energy of the incident light photoelectron $e^-$ is emitted from the photosensitive layer.

A photomultiplier including such reflection-type photocathode is fabricated as follows. First, a vacuum vessel is prepared. An Al film is formed by vacuum vaporization on a part for the reflection-type photocathode to be formed on. Subsequently Sb is vaporized directly on the Al film without the step of oxidizing the Al film. It is preferable that at this time the Sb is vaporized in a thin film or a porous film, of a 15 $\mu g/cm^2$ to 45 $\mu g/cm^2$ thickness.

Then one or some of alkali metals, such as Cs, Na, K, etc. are introduced to activate and anneal the Sb layer. Temperature conditions, periods of time, etc. of the activation and annealing are optionally determined as known. The temperature is selected in 140° C. to 220° C.

The fabrication procedure of the other elements of the photomultiplier, e.g., dynodes, microchannel plates, anodes, etc. is the same as that for the conventional photomultipliers. When the formation of the reflection-type photocathode and the fabrication of the elements are over, the vacuum vessel is sealed, and the photoelectric multiplier is completed.

Next, examples of the photomultiplier according to this invention will be explained. In each example the base substrate 1 was a Ni plate, and the Al film 2 was formed on a surface of the substrate 1 in a thickness of hundreds Å (by vacuum vaporization). The Sb layer 3 was directly formed on the Al film 2.

The thickness of the Sb layer was about 180 μg/cm$^2$ in a first example and about 30 μg/cm$^2$ in a second example. Then Na, K and Cs were let in to activate the Sb layer, and multi-alkali (Na—K—Cs—Sb) photocathode was prepared.

Figure 2:
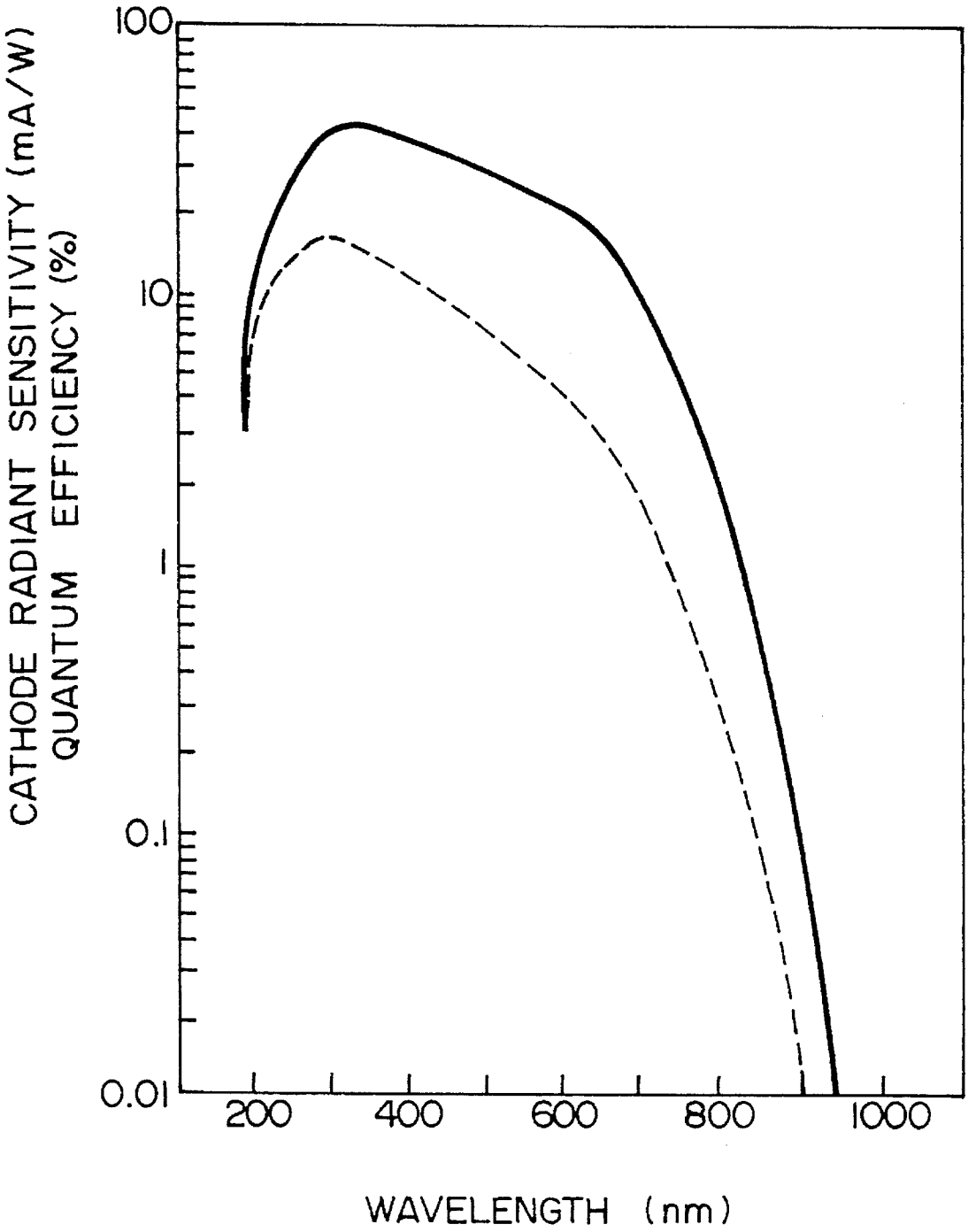
FIG. 2 is a graph of the spectral sensitivity characteristic of the reflection-type photocathode according to a first example.

The first example had the spectral sensitivity characteristic of FIG. 2. The dot line indicates its quantum efficiency, and the solid line indicates its cathode emission sensitivity. The average lumen sensitivity is 80 (μA/1 m). The second example had the spectral sensitivity characteristic of FIG. 3. Its average lumen sensitivity is as high as 200 (μA/1 m).

Figure 3:
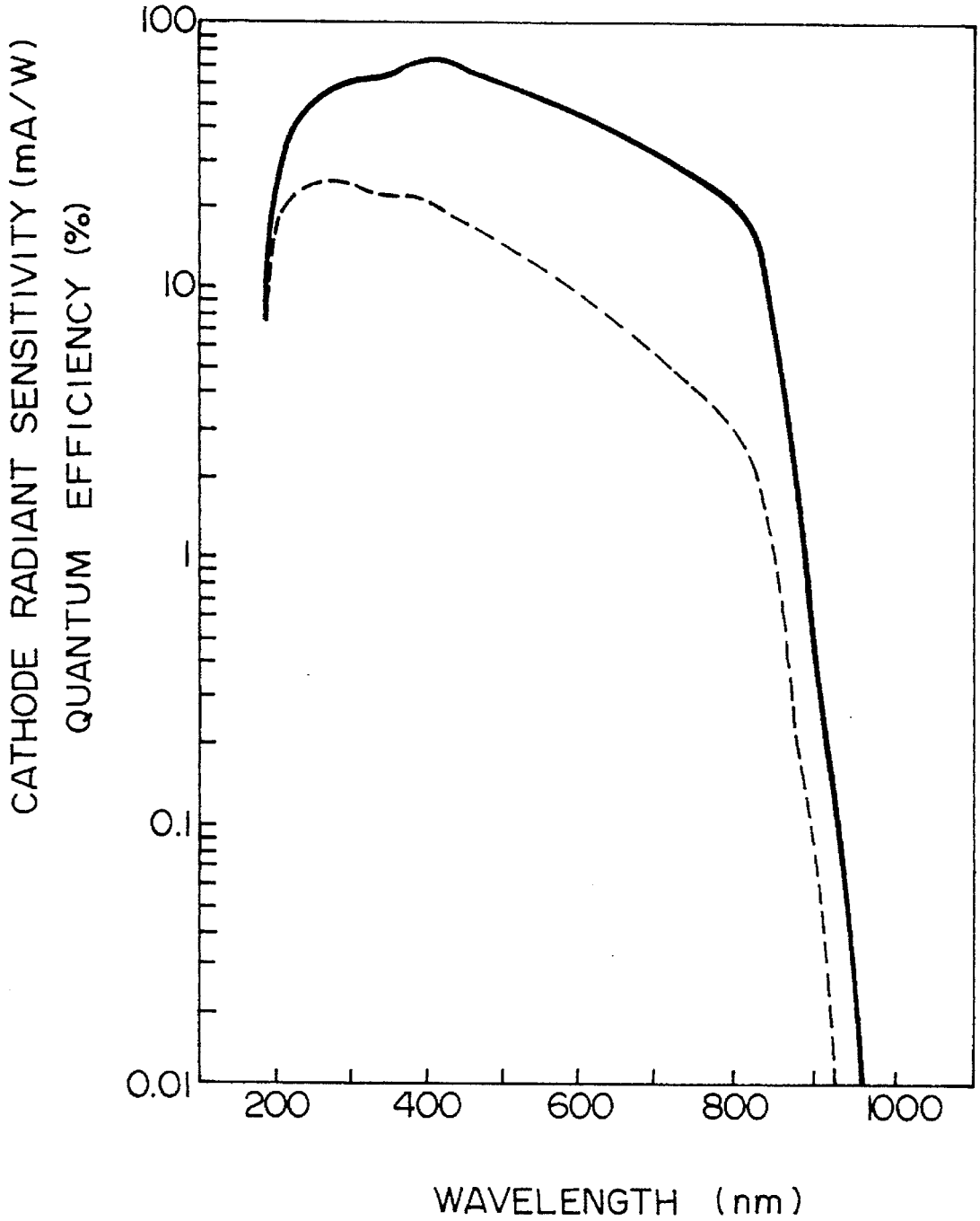
FIG. 3 is a view of the spectral sensitivity characteristic of the reflection-type photocathode according to a second example.

As seen from the comparison between FIGS. 2 and 3, the reduction of the Sb layer thickness can attain great sensitivity improvement. A cause of this improvements is considered to be as follows. That is, since the Al film is in direct contact with the photosensitive layer 3, the reflectivity of the incident light (light to be detected) is improved, and more photoelectrons are generated in the photosensitive layer 3. In the case that the photosensitive layer 3 is too thick, the generated photoelectrons are adversely trapped by the photosensitive layer 3 itself before emitted into a vacuum, with the result of low electron yields. But in the case that the photosensitive film 3 is thin, the photoelectron trapping ratio can be low, with the result of higher ratios of emitting photoelectrons into a vacuum.

In the case that the photosensitive film 3 is too thin, even if more light is reflected on the Al film 2, the photosensitive layer 3 less contributes to the generation of photoelectrons. The Sb layer has the optimum thickness, and the inventors have found that the optimum thickness of the Sb layer is 15 μg/cm$^2$~45 μg/cm$^2$.

The above-described embodiment has been explained by means of the multialkali photocathode, but Cs—Sb or Cs—K—Sb (bialkali) photocathodes may be used. The base substrate is not limited to Ni.

What is claimed is:

1. A reflection-type photocathode, comprising:

a substrate made of nickel;

a reflection layer of aluminum formed on an upper surface of the substrate; and a photosensitive layer formed directly on the reflection layer and formed of antimony activated with at least one kind of alkali metal.

2. A reflection-type photocathode according to claim 1, wherein the photosensitive layer is formed by depositing an antimony layer directly on the reflection layer, and activating the antimony layer by introducing at least one kind of alkali metal.

3. A reflection-type photocathode according to claim 1, wherein the alkali metal includes cesium.

4. A reflection-type photo-electric surface according to claim 1, wherein the alkali metal includes potassium.

5. A reflection-type photocathode according to claim 1, wherein the alkali metal includes sodium.

6. A reflection-type photocathode according to claim 1, wherein the alkali metal includes rubidium.

7. A photomultiplier comprising a vacuum vessel accommodating a reflection-type photocathode according to claim 1; photomultiplying means for multiplying photoelectrons emitted from the reflection-type photocathode; and an anode for receiving multiplied photoelectrons.

8. A method for fabricating a reflection-type photocathode, comprising:

the step of depositing a reflection layer of aluminium on the upper surface of a substrate made of nickel; and the step of forming a photosensitive layer by depositing an antimony layer directly on the reflection layer and subsequently activating the antimony layer with an alkali metal.

9. A method for fabricating a photocathode according to claim 8, wherein the photosensitive layer is formed by depositing directly on the reflection layer the antimony layer in a thickness of 15 μg/cm$^2$ to 45 μg/cm$^2$, and then activating the antimony layer with the alkali metal.

10. A method for fabricating a photocathode according to claim 8, wherein the photosensitive layer is formed by activating with the alkali metal the antimony layer deposited directly on the reflection layer, and then annealing the activated antimony layer.

* * * * *